US006976597B2

(12) United States Patent
Jährling et al.

(10) Patent No.: US 6,976,597 B2
(45) Date of Patent: Dec. 20, 2005

(54) WIDTH-ADJUSTABLE CARRIER FRAME USABLE IN HOUSEHOLD APPLIANCES, PARTICULARLY IN COOKING AND BAKING OVENS

(75) Inventors: Peter Jährling, Bünde (DE); Jürgen Bachor, Kirchlengern (DE)

(73) Assignee: Paul Hettich GmbH & Co., Kirchlengern (DE)

( * ) Notice: Subject to any disclaimer, the term of this patent is extended or adjusted under 35 U.S.C. 154(b) by 119 days.

(21) Appl. No.: 10/408,457

(22) Filed: Apr. 8, 2003

(65) Prior Publication Data

US 2003/0192847 A1 Oct. 16, 2003

(30) Foreign Application Priority Data

Apr. 13, 2002 (DE) ..... 202 05 788 U

(51) Int. Cl.[7] ..... A47F 5/00
(52) U.S. Cl. ..... 211/175; 211/153; 211/90.02
(58) Field of Search ..... 211/133.6, 126.15, 211/162, 151, 88.02, 175, 181.1, 153, 43, 211/105.4, 90.02, 105.3; 108/143, 107; 312/410, 312/351, 330.1; 248/149, 157, 241, 274.1, 248/298.1, 99, 405, 410, 411, 161; 403/109.4, 403/299, 109.1, 200

(56) References Cited

U.S. PATENT DOCUMENTS

| | | | | |
|---|---|---|---|---|
| 2,015,389 A | | 9/1935 | Whitted | |
| 2,040,996 A | | 5/1936 | Hungerford | |
| 2,885,090 A | * | 5/1959 | Forman et al. | 211/175 |
| 2,902,592 A | * | 9/1959 | Cole et al. | 362/277 |
| 3,391,893 A | * | 7/1968 | Doerner | 248/405 |
| 3,417,875 A | * | 12/1968 | Barker | 211/86.01 |
| 3,850,010 A | * | 11/1974 | Noto | 63/1.16 |
| 4,202,521 A | * | 5/1980 | Harding | 248/98 |
| 5,086,936 A | * | 2/1992 | Remmers | 211/126.15 |
| 5,330,063 A | * | 7/1994 | Remmers | 211/162 |
| 5,331,904 A | * | 7/1994 | DiSimone et al. | 108/44 |
| 5,549,499 A | * | 8/1996 | Foskey et al. | 446/268 |
| 5,579,848 A | * | 12/1996 | Hsu | 172/378 |
| 5,645,182 A | * | 7/1997 | Miller et al. | 211/134 |
| 6,109,462 A | * | 8/2000 | Emalfarb et al. | 211/119 |
| 6,148,813 A | * | 11/2000 | Barnes et al. | 126/339 |
| 6,644,302 B1 | * | 11/2003 | Bartley | 126/337 R |
| 2004/0112371 A1 | * | 6/2004 | Le et al. | 126/334 |
| 2004/0149668 A1 | * | 8/2004 | Fann et al. | 211/74 |

FOREIGN PATENT DOCUMENTS

| | | |
|---|---|---|
| DE | G 88 05 174.9 | 4/1988 |
| DE | G 89 15 074.0 | 12/1989 |
| DE | 4023206 A | 6/1991 |
| DE | 9403451 U | 6/1994 |
| WO | WO 9947863 A | 9/1999 |

* cited by examiner

*Primary Examiner*—Jennifer E. Novosad
(74) *Attorney, Agent, or Firm*—Barnes & Thornburg LLP

(57) ABSTRACT

A width-adjustable carrier frame for receiving and supporting a grilling rack, a tray, a dish, a cooking or baking sheet, or the like of an oven. The carrier frame consist of at least two cross members with tube-type front-side end areas and two approximately U-shaped carrying bows. At least one carrying bow is continuously adjustable relative to the cross member by a worm drive.

12 Claims, 13 Drawing Sheets

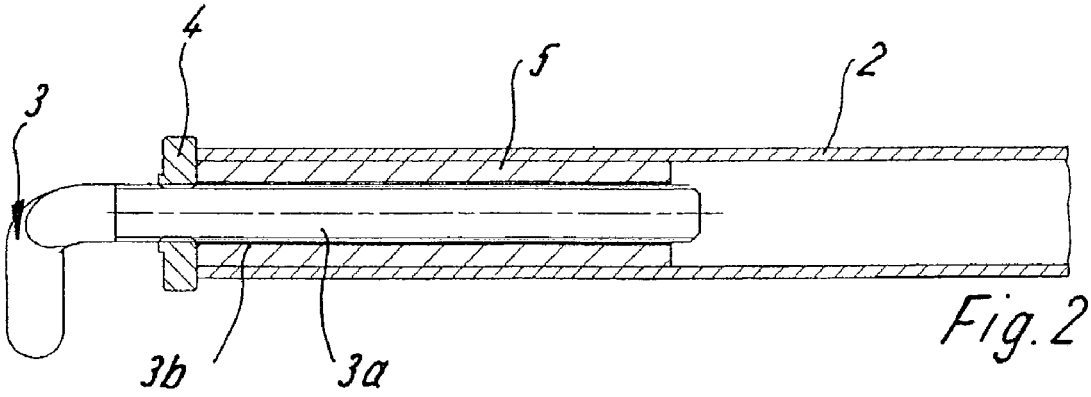
Fig. 2
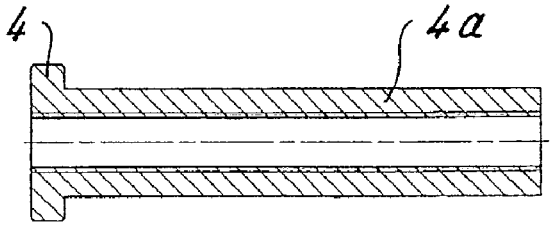
Fig. 3
Fig. 4
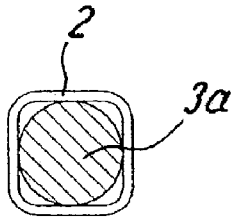
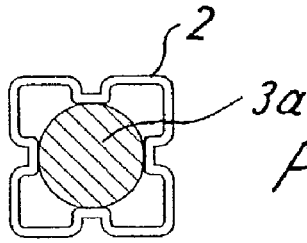
Fig. 5
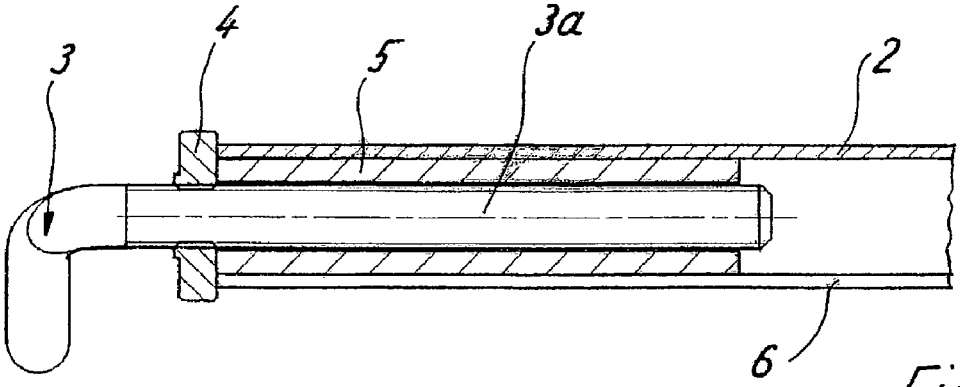
Fig. 6

WIDTH-ADJUSTABLE CARRIER FRAME USABLE IN HOUSEHOLD APPLIANCES, PARTICULARLY IN COOKING AND BAKING OVENS

This non-provisional application claims benefit of German Application Serial No. 202 05 788.7 filed Apr. 13, 2002 and which disclosure is incorporated herein by reference.

BACKGROUND AND SUMMARY OF THE INVENTION

The present invention relates to a width-adjustable carrier frame usable in household appliances, particularly in cooking and baking ovens, for receiving and supporting a grilling rack, a tray, a dish, a cooking or baking sheet, or the like.

Width-adjustable frying or grilling racks are known, as shown in (German Patent Document DE-GM 89 15 074). A certain width adjustment can be fixed by locking devices.

This means that the change of the width of the frying or grilling rack can only be in steps.

In German Patent Document DE-GM 88 05 174, a width adjustable baking sheet with U-shaped outside bows can also be held in a desired width adjustment by locking devices.

In U.S. Patent Document U.S. Pat. No. 2,015,389, a refrigerator rack is shown, where tube-shaped cross-members, in the area of their ends, carry spring-loaded headless screws which engage in wall-side recesses of a refrigerator. After the spring-loaded headless screws were threaded into the wall-side recesses, a final fixing can be achieved by a tightening of nuts.

Although such a construction permits a continuous width adjustment of the refrigerator rack, the mounting or demounting of such a refrigerator rack requires very high expenditures. Specifically, all four headless screws have to be inserted into the recesses and four nuts have to be correspondingly tightened or released in order to mount or demount the refrigerator rack.

In addition, a refrigerator rack designed in this manner can be used only when the walls of the refrigerator are equipped with corresponding recesses for the headless pins.

It is an object of the present invention to provide a carrier frame of the above-mentioned type which, while it can be easily handled, can be used in household appliances with different interior width measurements and, as required, can also be secured against being unintentionally pulled out.

According to the invention, the carrier frame consists of as at least two cross members with tube-type front-side end areas and of two approximately U-shaped carrying bows whose free ends project into the tube-type end areas and in that at least one carrying bow is continuously adjustable relative to the cross members by means of a worm drive.

A carrier frame designed in this manner can be comfortably adapted to interiors of different widths of household appliances by operating the worm drive; specifically, a continuous adaptation can be achieved in a simple manner.

If required, the carrier frame can also be pressed onto the interior walls of a household appliance by the worm drive and can therefore be force-lockingly fixed and thus sufficiently secured against an unintentional pulling-out.

These and other aspects of the present invention will become apparent from the following detailed description of the invention, when considered in conjunction with accompanying drawing.

BRIEF DESCRIPTION OF THE DRAWINGS

FIG. 2 is a partial sectional view of an end area of a cross member of the carrier frame according to FIG. 1.

FIG. 3 is a longitudinal sectional view of a guide bushing as an alternative to the construction according to FIG. 2.

FIGS. 4 and 5 are possible cross-sectional views of cross members.

FIG. 6 is a longitudinal sectional view corresponding essentially to FIG. 2 of a cross member according to another embodiment of the invention.

DETAILED DESCRIPTION OF THE PREFERRED EMBODIMENTS

Figure 1:
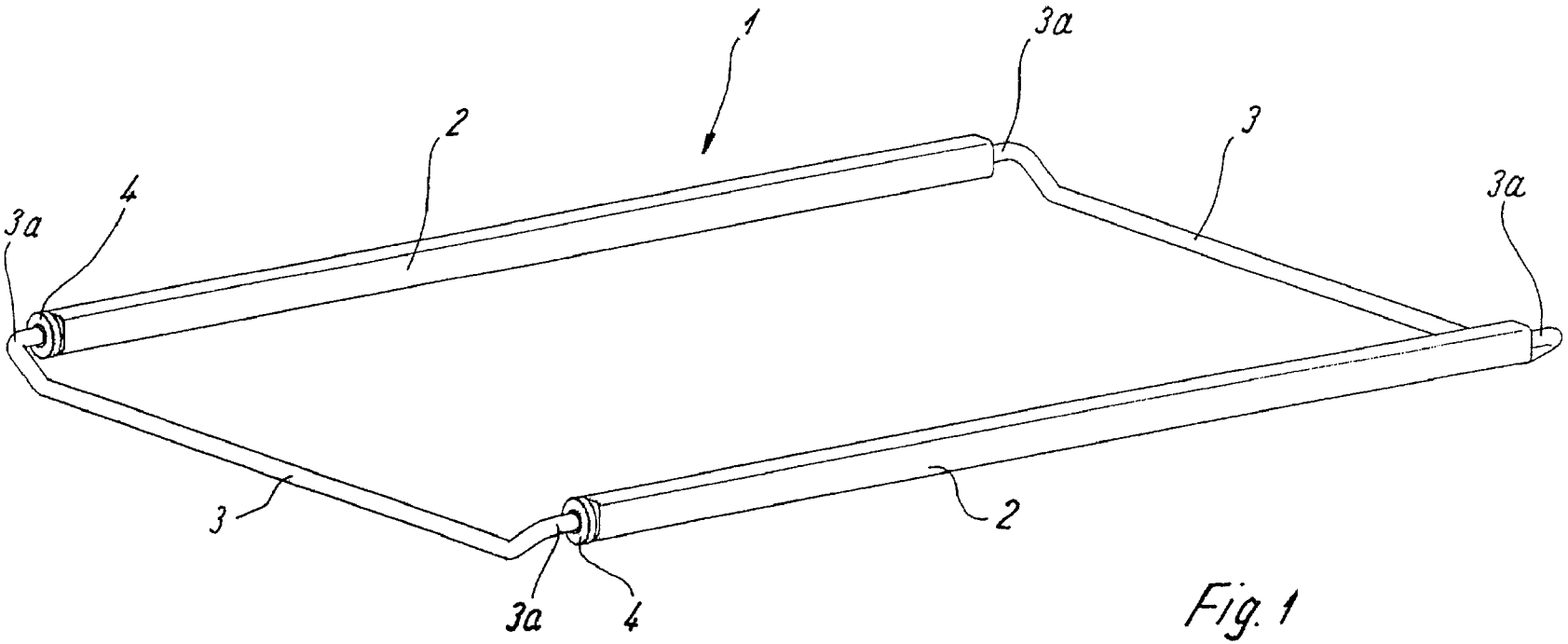
FIG. 1 is a perspective view of a carrier frame according to the invention.

In FIG. 1, a carrier frame as a whole has the reference number 1 and is intended to be used in household appliances, particularly in cooking and baking ovens, and is provided for receiving and supporting a rack, such as a grilling rack, a tray, a dish, a cooking or baking sheet, or the like.

The carrier frame 1 consists essentially of two cross members 2 with at least tube-type front-side end areas as well as of two approximately U-shaped carrying bows 3. The free ends 3*a* of the carrying bows 3 project into the front-side ends of the cross members 2 so that the carrier frame 1 is closed in itself.

In the embodiment according to FIGS. 1 and 2, the free ends 3*a* of one carrying bow 3 are fixedly connected with the cross members 2, while the free ends 3*a* of the other carrying bow 3 are equipped with an external thread 3*b*. On this external thread 3*b*, one threaded nut 4 respectively is arranged which is freely rotatable with respect to the cross member 2 but is axially firmly connected with the latter. Tehe external thread 3*b* and threaded nut 4 form a worm drive.

As a result of the operation of the two nuts 4, the corresponding carrying frame 3 can be adjusted or displaced in both directions in the direction of the opposite additional carrying bow 3.

The entire carrier frame 1 can therefore be adjusted in its width and can be adapted to differently sized interiors of household appliances. The width of the carrier frame 1 can optionally be enlarged to such an extent that a press fit of the carrier frame 1 is obtained inside the interior of a household appliance, whereby an unintentional pulling-out of the carrier frame 1 is prevented or at least made more difficult.

As illustrated in FIG. 2, a guide bushing 5 for the longitudinal guidance of the free ends 3*a* of the corresponding carrying bow 3, which are longitudinally displaced with respect to the cross member, is arranged inside the respective cross member 2.

FIG. 3 indicates that such a guidance can also be produced by an extension shaft 4*a* of a nut 4 for the longitudinal adjustment of the respective carrying bow 3.

FIGS. 4 and 5 indicate that a good guidance of the free ends 3*a* can also be produced by corresponding cross-sectional shapes of the cross members 2.

Finally, FIG. 6 again shows a construction with a separate guide bushing 5 which is inserted in a cross member 2 in this case provided with a longitudinal slot 6.

Figure 7:
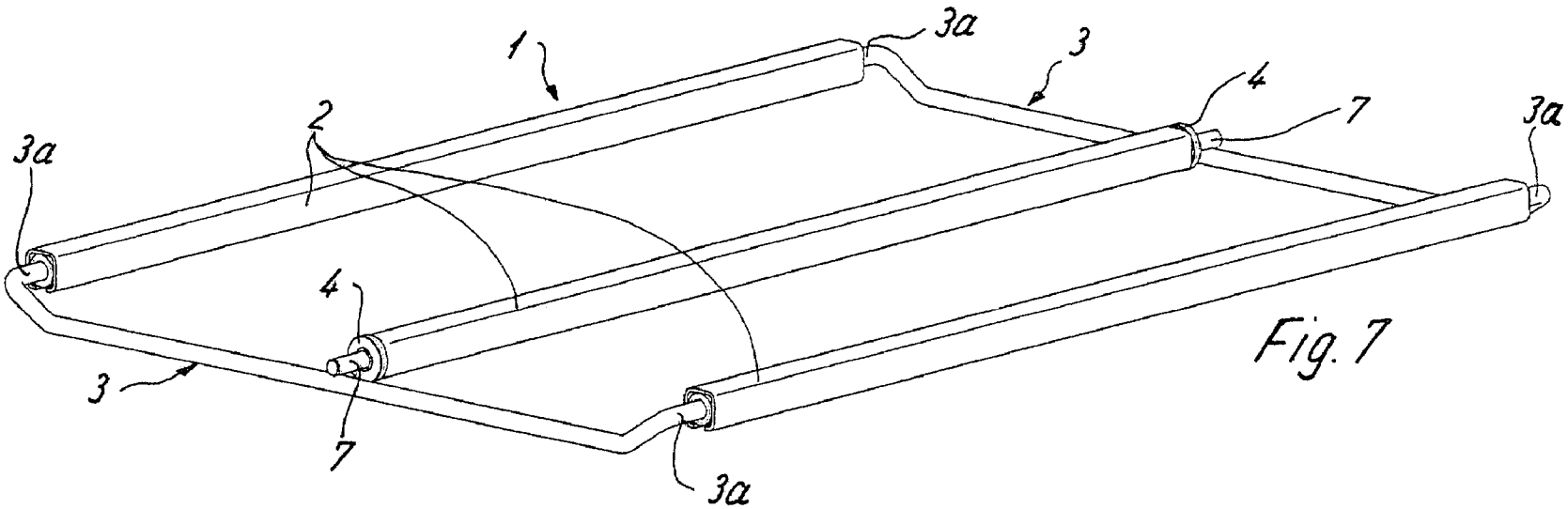
FIG. 7 is a perspective view of a carrier frame according to another embodiment of the invention.
Figure 8:
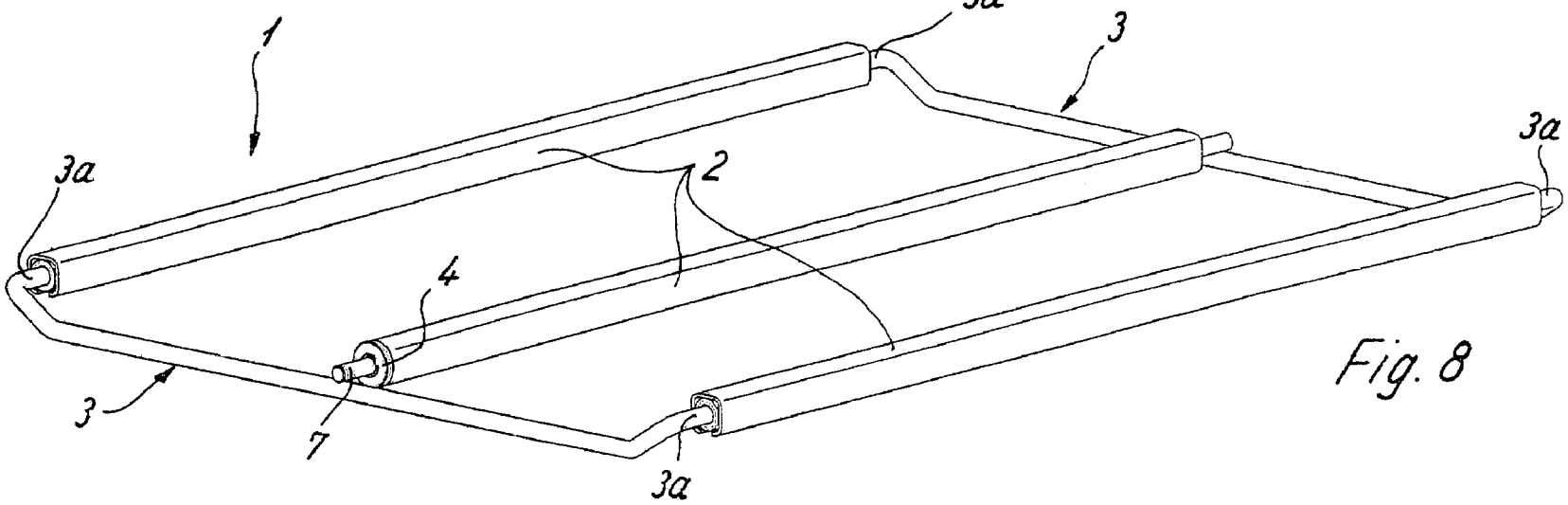
FIG. 8 is a perspective view of as carrier frame according to another embodiment of the invention.

FIGS. 7 and 8 show embodiments for a carrier frame 1 in which another center cross member 2 is provided between the two outer cross members 2. Threaded rods 7, which are fixedly connected with the carrying bows 3, engage the center cross member 2, while the free ends 3*a* of the carrying bows 3 projecting into the outer cross members 2 are freely displaceable in these outer cross members 2.

By means of nuts 4, which are arranged on the threaded rods 7 and are rotatably but axially stationarily connected with the center cross member 2, a width adjustment of the carrier frame 1 can also take place.

The difference with respect to the two embodiments according to FIGS. 7 and 8 is that, in the embodiment according to FIG. 7, nuts 4 for adjusting the width are provided on the two front-side ends of the cross member 2, while, in the embodiment according to FIG. 8, a nut 4 for the width adjustment of the carrier frame 1 is provided only of on one front side of the center cross member 2.

Figure 10:
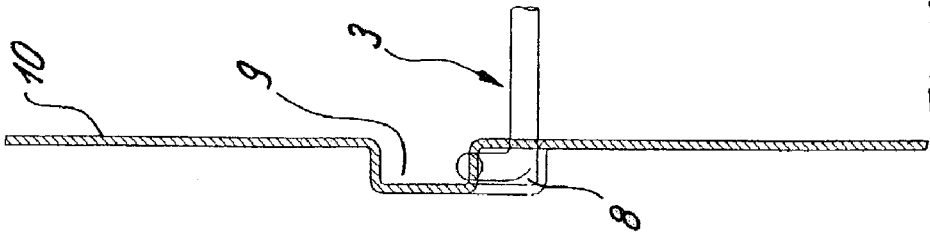
FIG. 10 is a vertical sectional view of the side wall according to FIG. 9.
Figure 9:
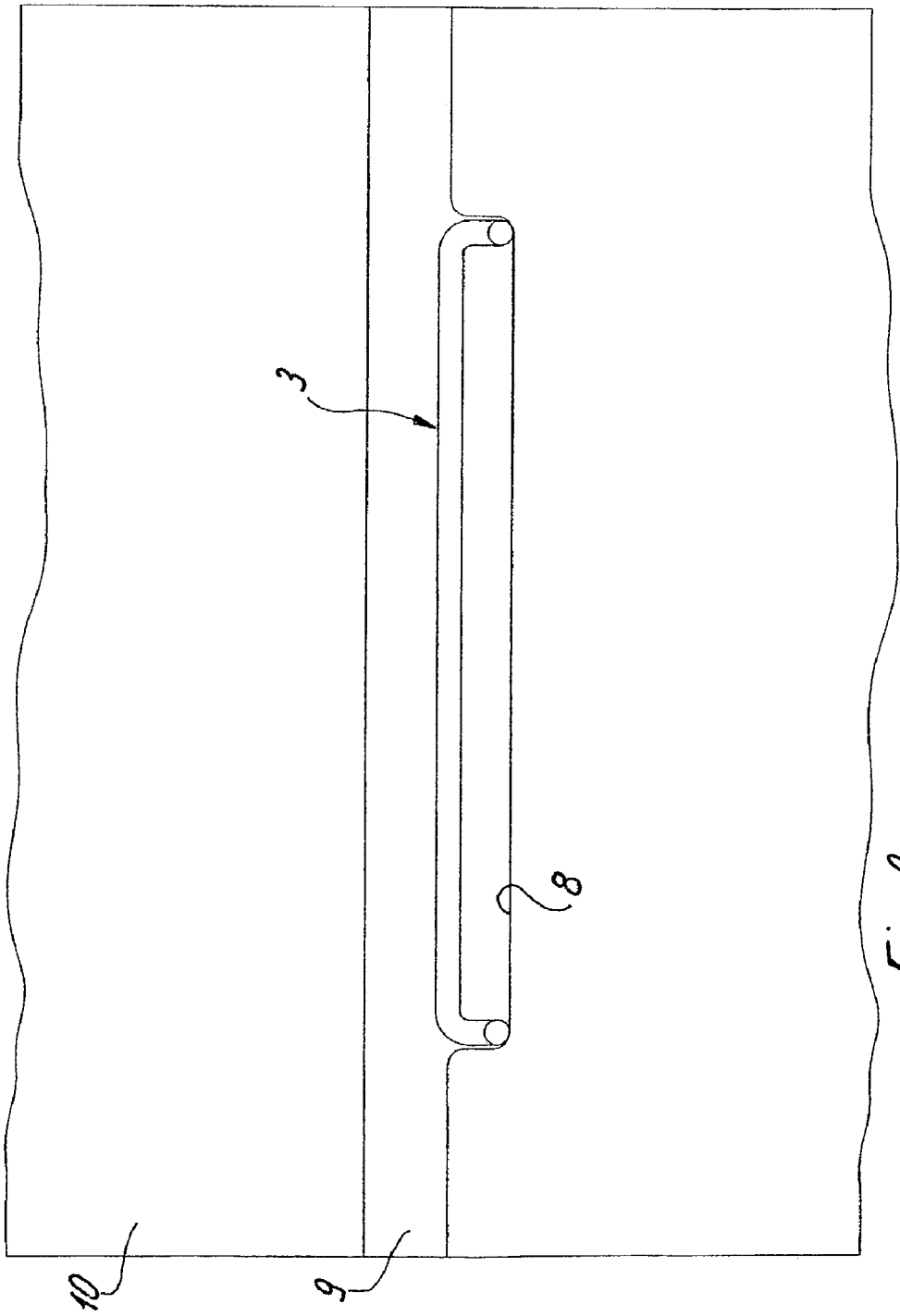
FIG. 9 is a schematic interior view of a side wall of a household appliance with a guide slot and a carrying bow of a carrier frame according to the invention which engages in the guide slot.

As illustrated in FIGS. 1 to 8, but particularly in FIGS. 9 and 10, the carrying bows 3 are bent a right angles out of the plane of the carrying frame 1. Thus, there is the possibility of inserting the carrier frame 1 in a displacement-resistant manner in a notch 8 of a guide slot 9 of an interior wall 10 of a household appliance which is not shown in detail.

Figure 12:
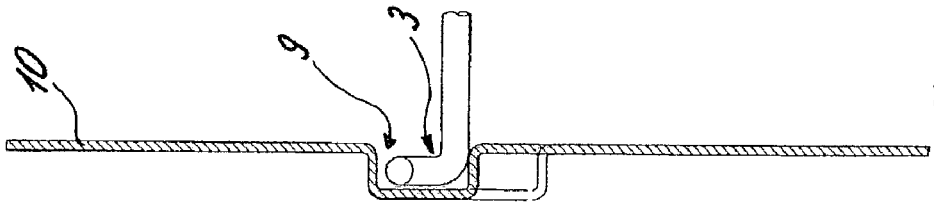
FIG. 12 is a vertical sectional view of the side wall according to FIG. 11.
Figure 11:
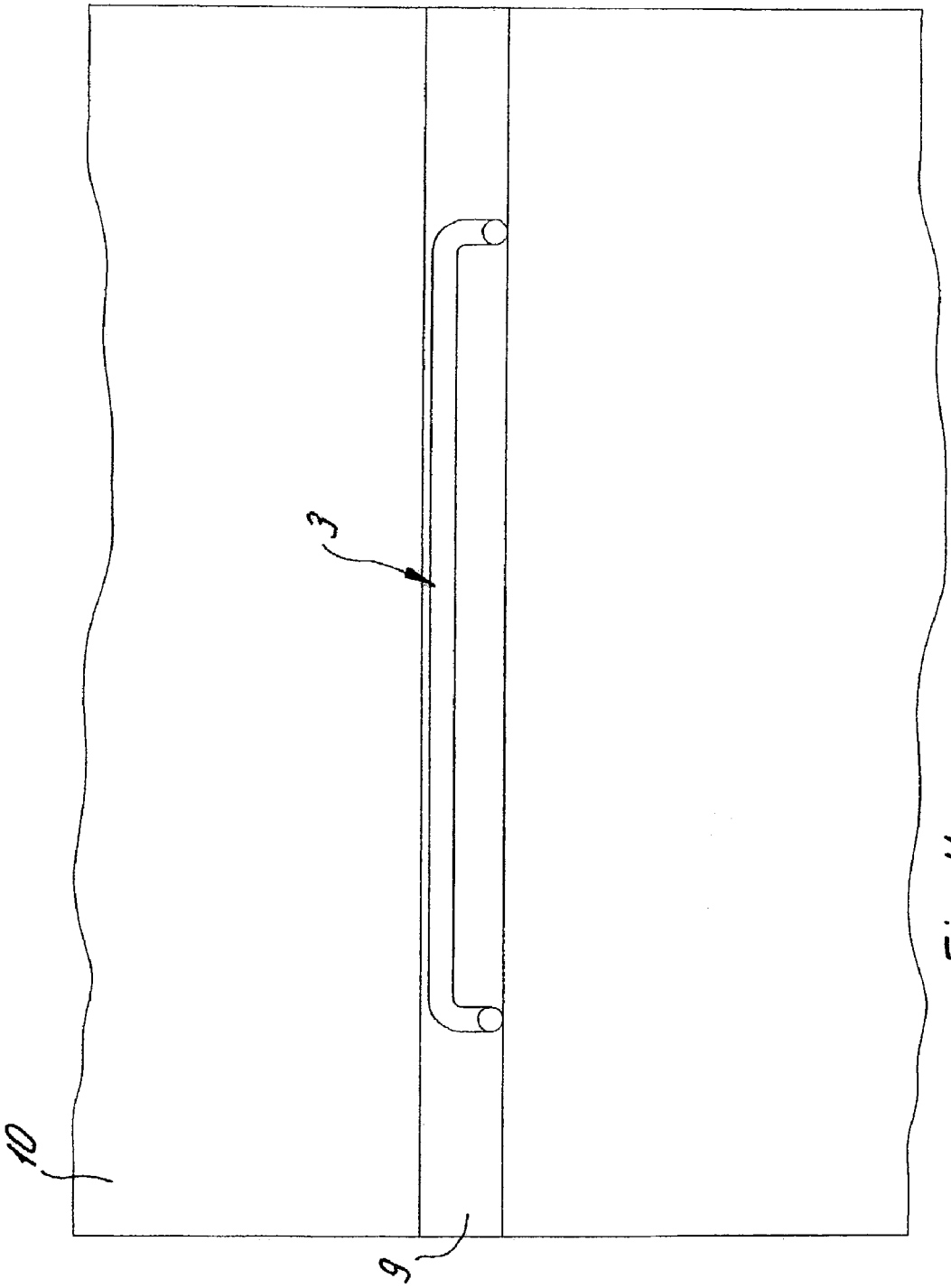
FIG. 11 is a view corresponding to FIG. 9 according to another embodiment of the invention.
Figure 13:
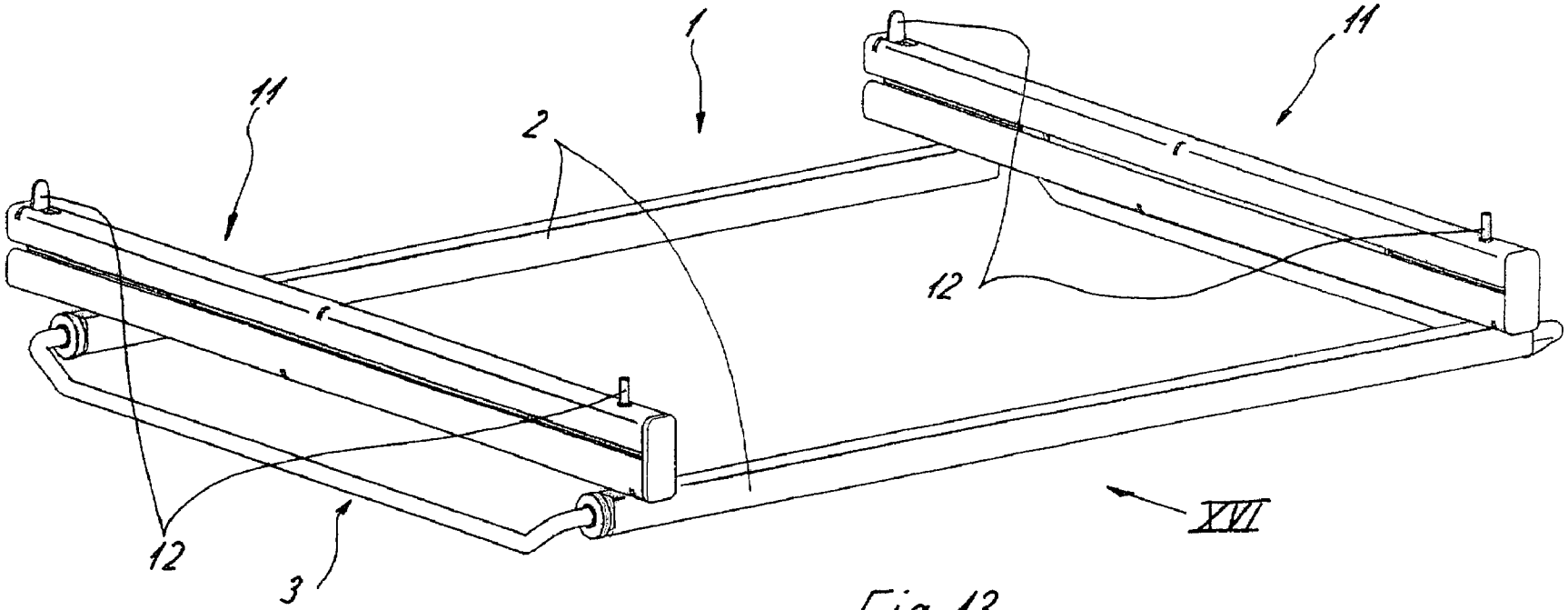
FIG. 13 is a perspective view of a carrier frame according to the invention with guides fastened thereon in the normal position.
Figure 14:
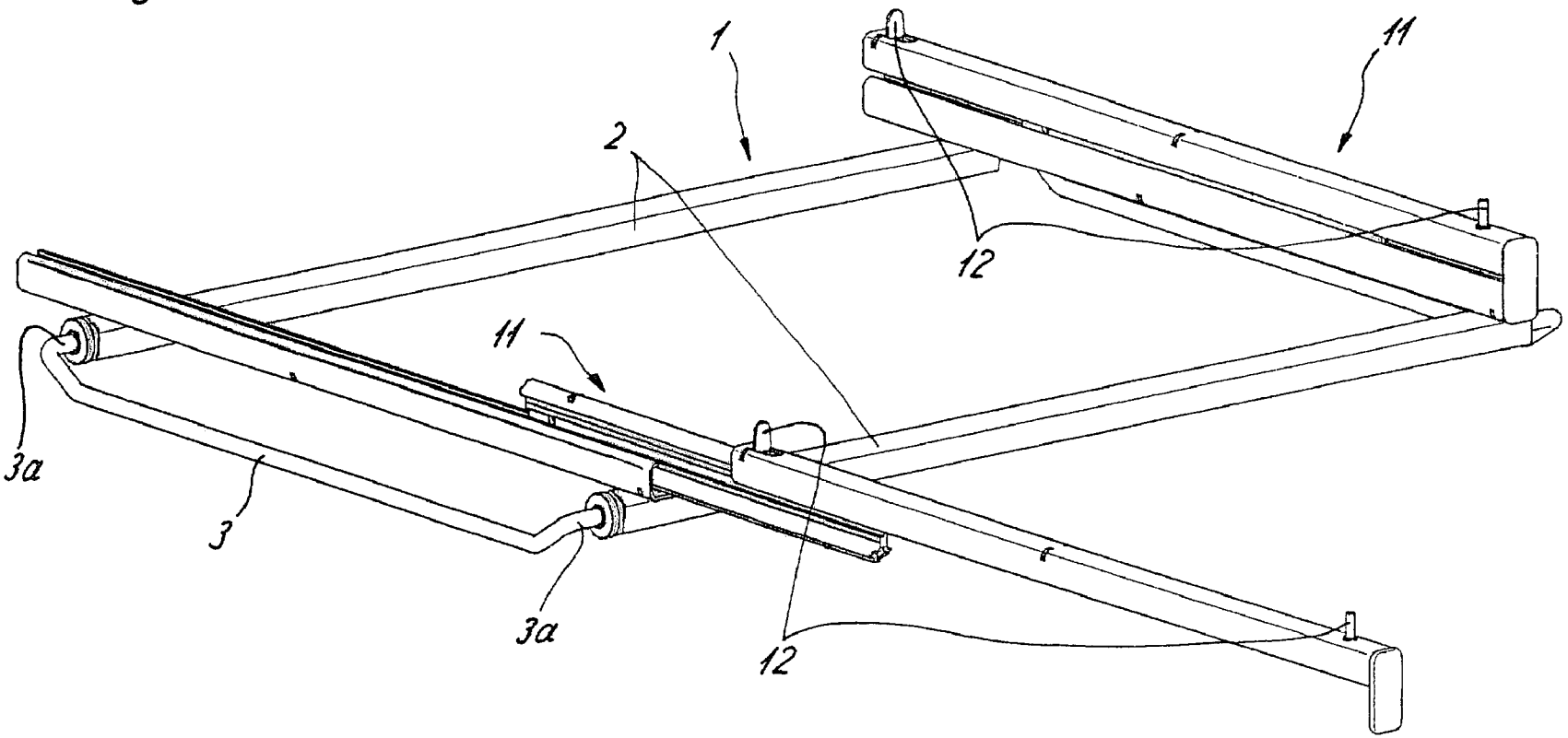
FIG. 14 is a perspective view according to FIG. 13 with a partially pulled-out guide.
Figure 15:
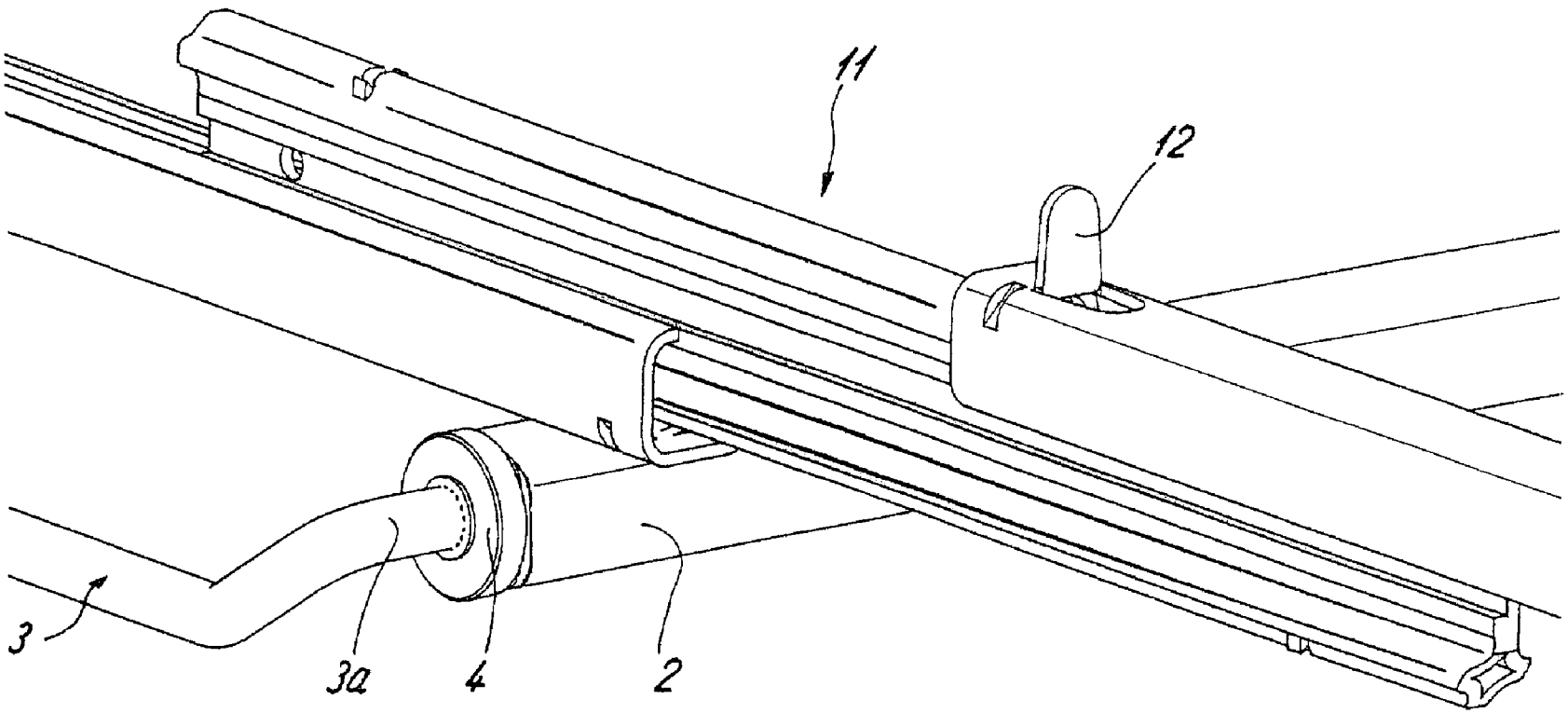
FIG. 15 is an enlarge view of a portion of FIG. 14.
Figure 16:
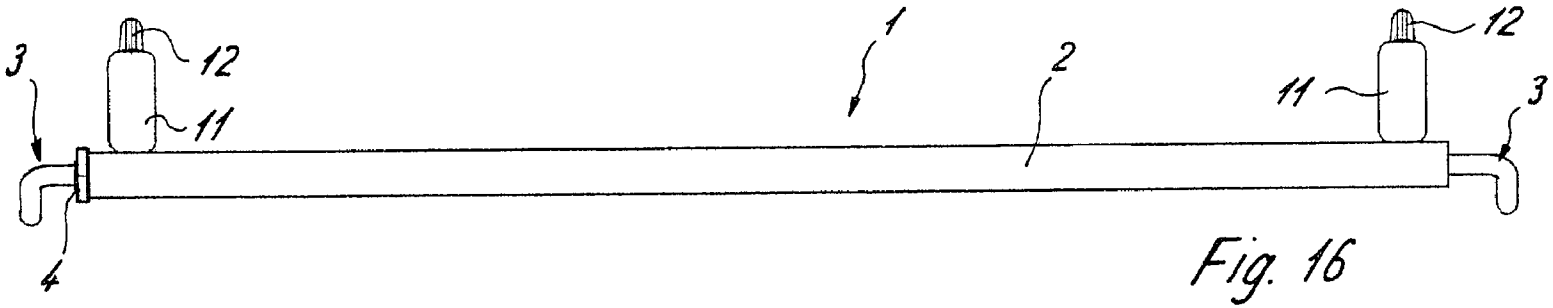
FIG. 16 is a view in the direction of the arrow XVI in FIG. 13.

The right-angle bending of the carrying bows 3 can also be used for fixing the entire carrier frame in a clamping manner in a correspondingly dimensioned guide slot 9 of an interior wall 10 of a household appliance (FIGS. 11, 12).

Furthermore, by way of the carrying bows 3, the carrier frame 1 can naturally be supported on any arbitrary known carrying device of a household appliance.

FIGS. 13–16 shows a carrier frame 1 according to the invention with guides 11 fastened on cross members 2. Advantageously, these are so-called full pull-outs.

Figure 17:
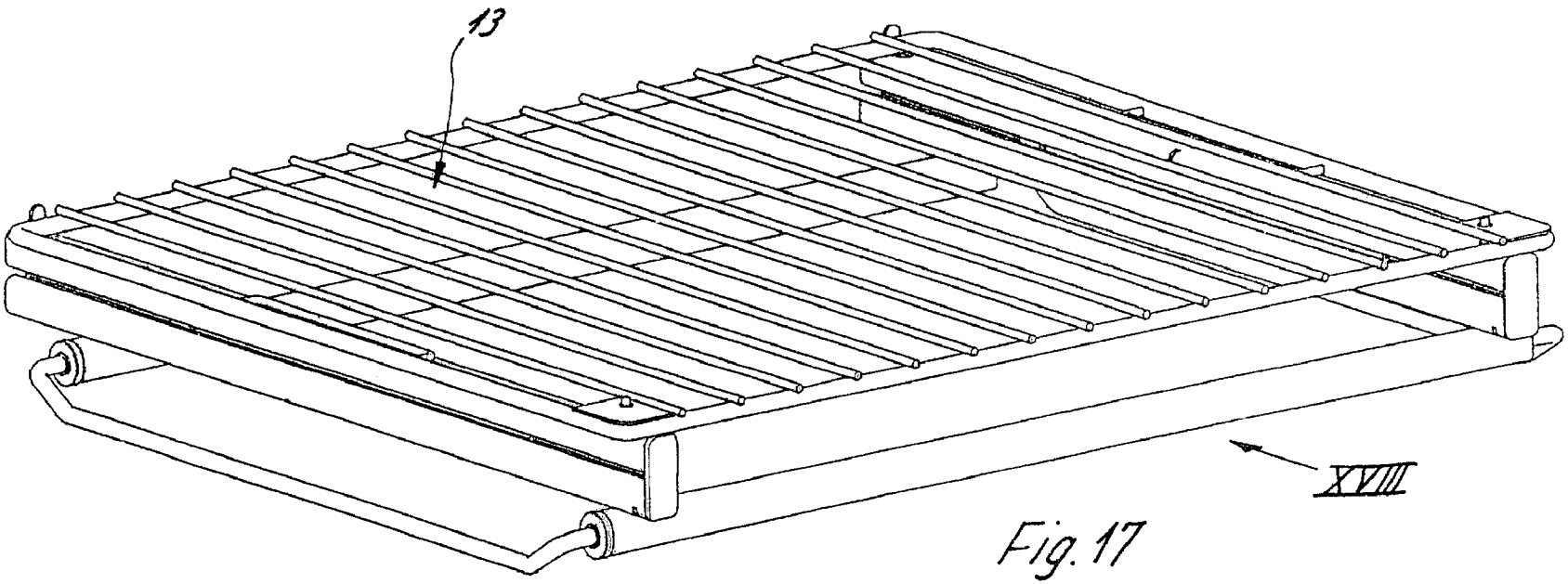
FIG. 17 is a perspective view of a carrier frame according to the invention with guides and a rack placed thereon.
Figure 18:
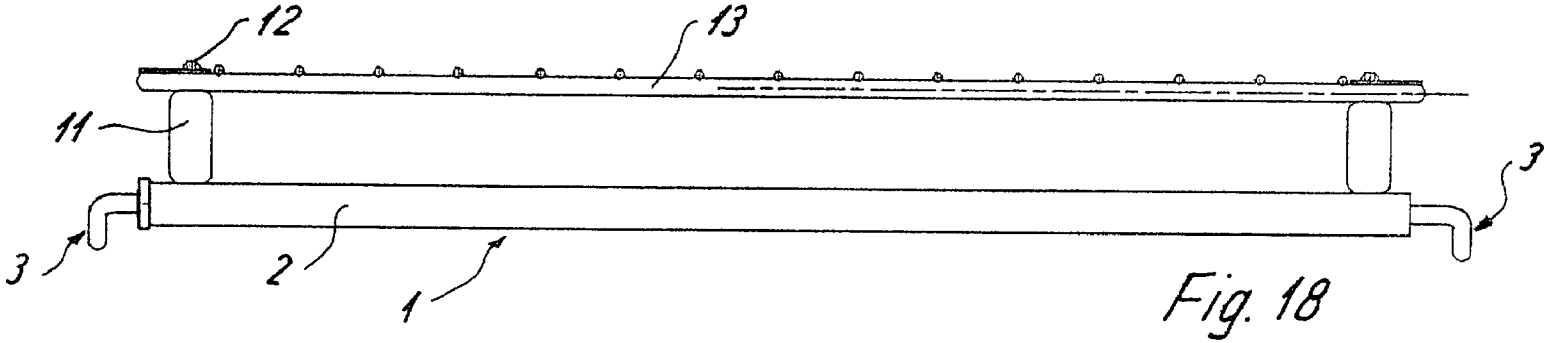
FIG. 18 is a view in the direction of the arrow XVIII in FIG. 17.

In their end areas, the guides 11 are provided with fixing noses 12 which have the purpose of receiving and fixing, for example, a rack 13, as illustrated in FIGS. 17 and 18.

Figure 19:
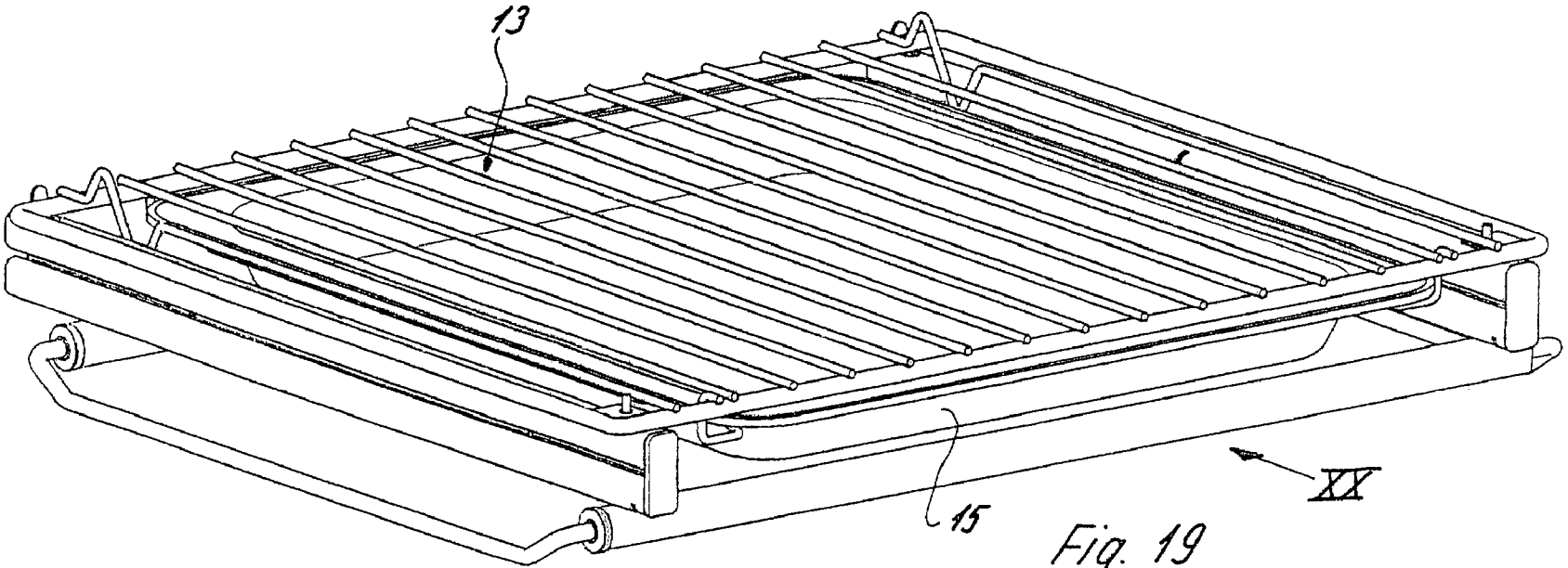
FIG. 19 is a perspective view of a carrier frame according to the invention with guides fastened thereto and rack held on the guides with devices for holding a drip pan or a baking sheet.
Figure 20:
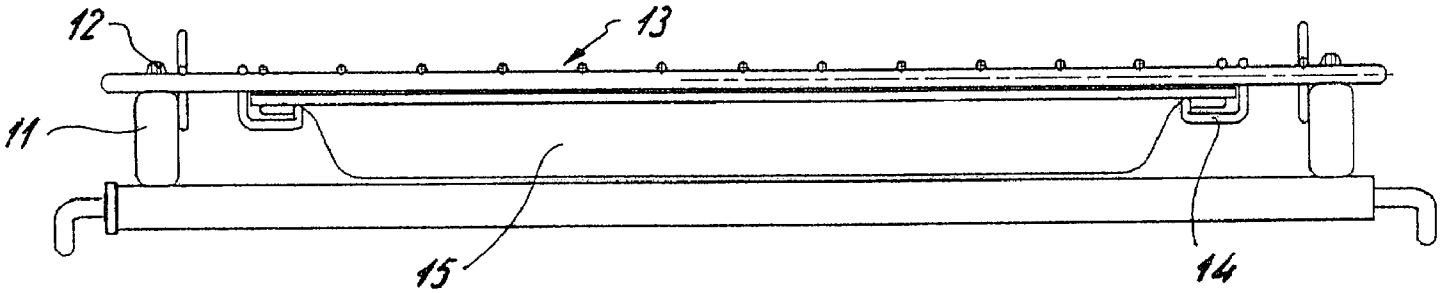
FIG. 20 is a view in the direction of the arrow XX in FIG. 19.

In this case, as illustrated in FIGS. 19 and 20, a rack 13 may be provided with holding devices 14, for example, for a dish 15.

Figure 21:
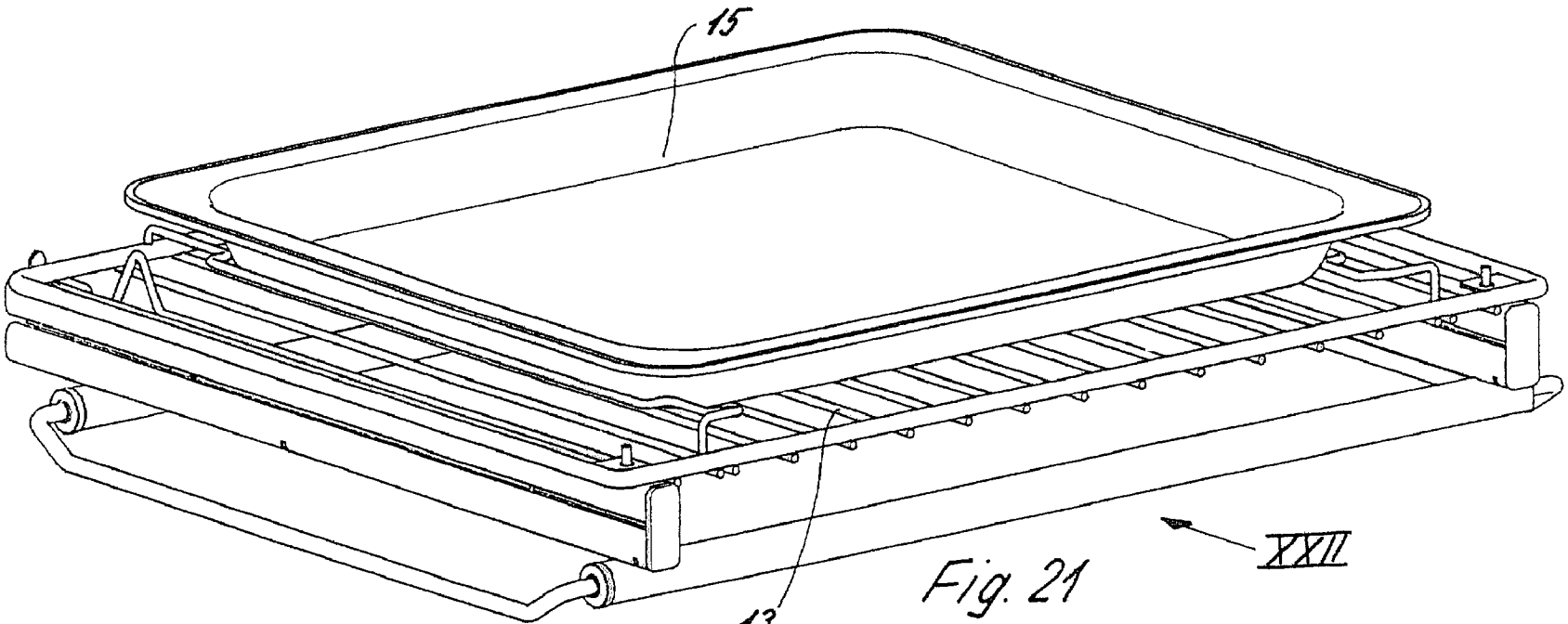
FIG. 21 is a view corresponding to FIG. 19 with a rack used in a reverse position and a corresponding drip pan.
Figure 22:
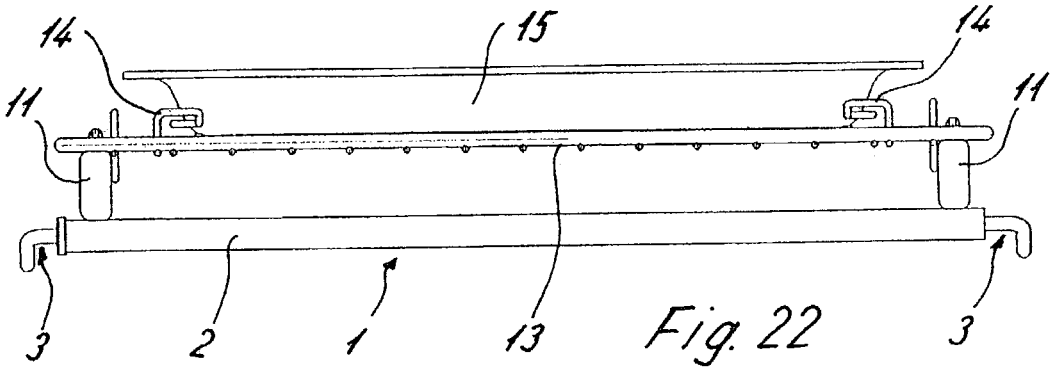
FIG. 22 is a view in the direction of the arrow XXII in FIG. 21.
Figure 23:
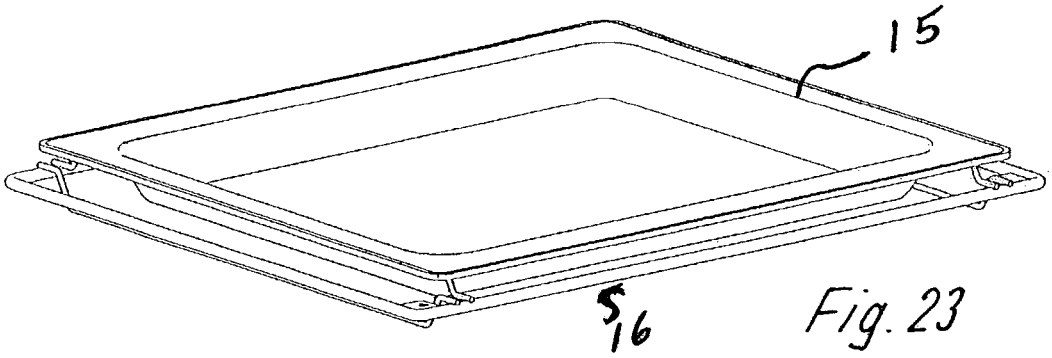
FIG. 23 is a perspective view of a rack receiving a dish or a baking sheet.
Figure 24:
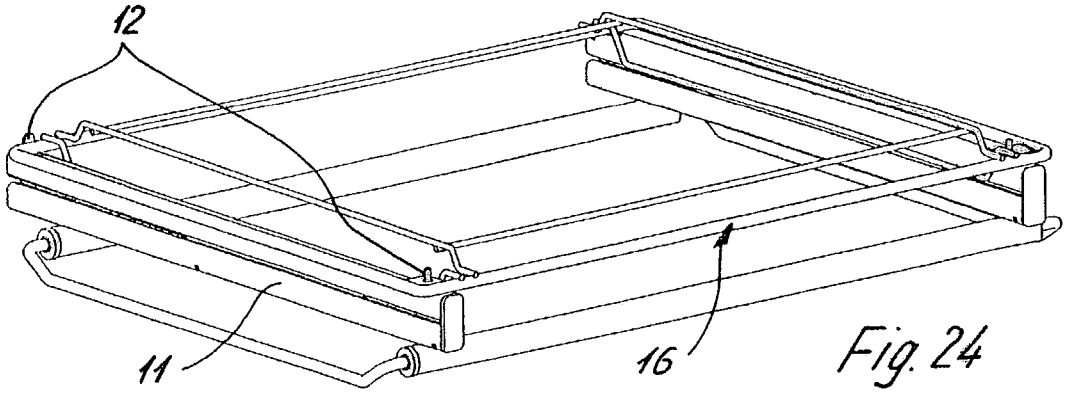
FIG. 24 is a perspective view of the rack according to FIG. 23 placed on the guides of a carrier frame.
Figure 25:
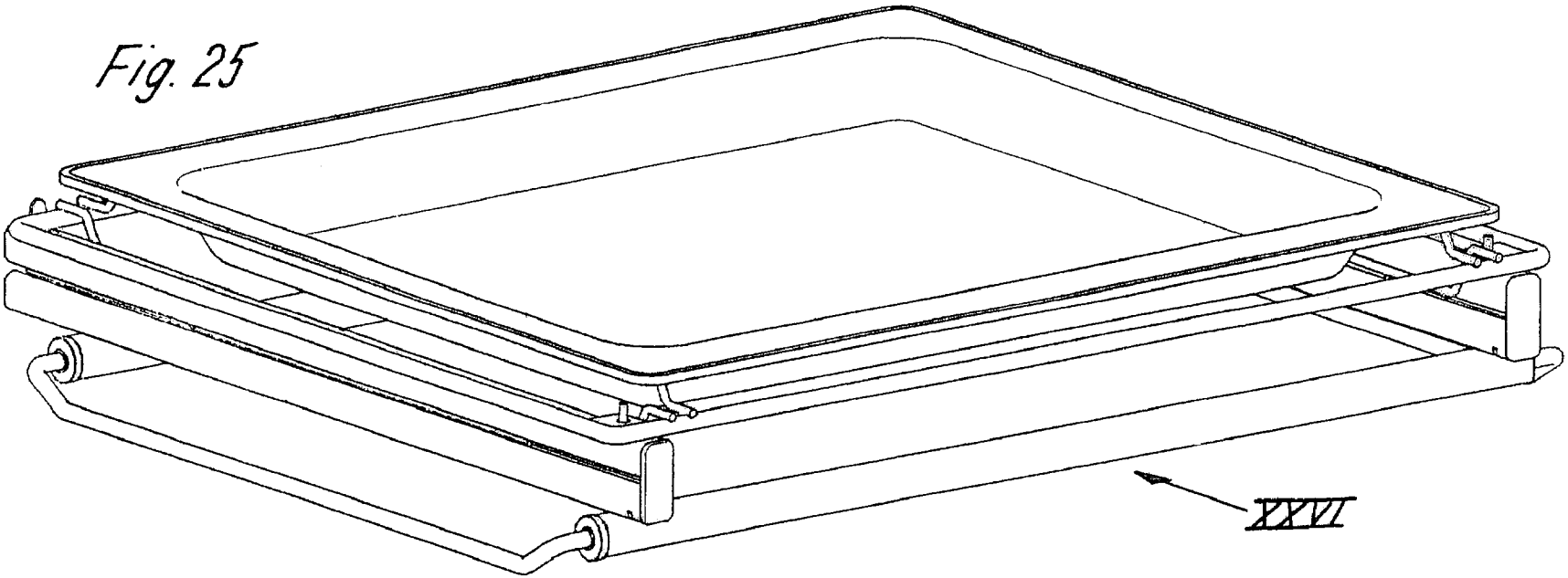
FIG. 25 is a perspective view corresponding to FIG. 24 with a placed dish.
Figure 26:
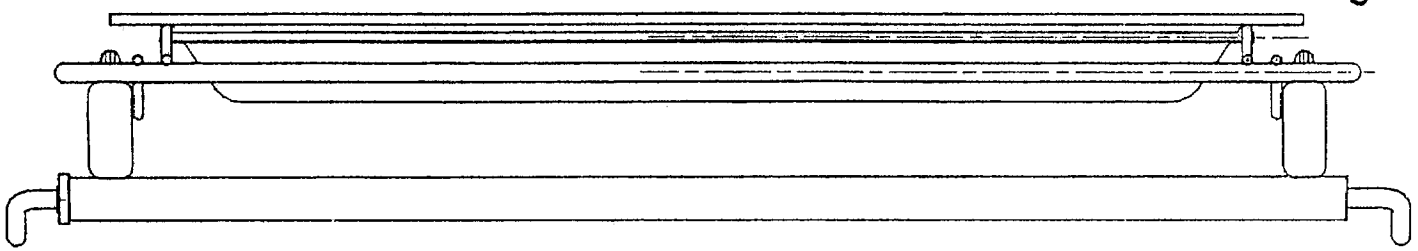
FIG. 26 is a view in the direction of the arrow XXVI in FIG. 25.

When the rack 13 is used in a reversed manner, the dish 15 may also fixedly rest on the rack 13, as illustrated in FIGS. 21 and 22.

FIGS. 23 to 26 shows an embodiment in which a simplified holding frame 16 is provided for supporting a dish or a baking sheet 15, which holding frame 16 is supported on the guides 11 and is secured by way of the fixing noses 12 connected with the guides 11.

On the one hand, the carrier frame 1 permits an unproblematic width adjustment as a result of the operating principle of the worm drive (external thread of the free ends 3*a* or threaded rods 7, on the one side, as well as a nut 4, on the other side) and by corresponding guides 11 with racks or holding frames placed upon the latter, the accommodation of many different articles, such as dishes, cooking sheets, or the like.

Although the present invention has been described and illustrated in detail, it is to be clearly understood that this is done by way of illustration and example only and is not to be taken by way of limitation. The scope of the present invention is to be limited only by the terms of the appended claims.

What is claimed is:

1. A width-adjustable carrier frame usable in ovens for receiving and supporting one or more of a grilling rack, a tray, a dish, a cooking and baking sheet, the carrier frame consists of at least two cross members with tube front-side end areas and two approximately U-shaped carrying bows which are adapted to support the frame in the oven, and at least one carrying bow is continuously adjustable relative to the cross members by a worm drive including a nut and a threaded member between the at least one carrying bow and the cross members to allow the frame to be supported in the oven.

2. The carrier frame according to claim 1, wherein the free ends of the carrying bows project into the tube front-side end areas of the cross members.

3. The carrier frame according to claim 2, wherein at least one of the free ends of a carrying bow includes an external thread, and the nut, which is rotatably but axially stationarily disposed in the end area of the cross members, is screwed onto this external thread.

4. The carrier frame according to claim 1, including a third cross member arranged between the two cross members on the frame; the third cross member includes at least one front-side end with a rotatable but axially stationarily fastened nut; a threaded rod engages the nut and is fixedly connected with one of the carrying bows; and the free ends of the adjustable carrying bow are freely displaceable in the longitudinal direction with respect to the two cross members.

5. The carrier frame according to claim 1, wherein the free ends of the adjustable carrying bow are guided in one or more of a guide bushing and a sleeve projection of the nut.

6. The carrier frame according to claim 1, wherein the free ends of the carrying bow, which are longitudinally adjustable inside the cross members, are guided by a corresponding cross-sectional design of the cross members in the end area in the longitudinal direction.

7. The carrier frame according to claim 1, wherein the carrying bows are bent at right angles out of a plane of the carrier frame.

8. The carrier frame according to claim 1, including guides fastened on the cross members.

9. The carrier frame according to claim 8, wherein the guides consist of full pull-outs.

10. The carrier frame according to claim 8, wherein the guides are equipped in forward and rearward end areas with fixing noses for fixing one or more of racks and carrier frames.

11. The carrier frame according to claim 1, wherein the carrying bows are each continuously adjustable relative to the cross members by a worm drive between the carrying bows and the cross members.

12. A width-adjustable carrier frame in an oven, the carrier frame including at least two cross members with tube front-side end areas and two approximately U-shaped carrying bows which support the frame in the oven, and at least one of the carrying bows is continuously adjustable relative to the cross members by a worm drive including a nut and a threaded member between the at least one carrying bow and the cross members to allow the frame to be supported in the oven.

* * * * *